US010380837B2

(12) United States Patent
Dallmeier

(10) Patent No.: US 10,380,837 B2
(45) Date of Patent: Aug. 13, 2019

(54) SYSTEM AND METHOD FOR DETECTING AND ANALYZING VIDEO DATA RELATING TO THE COURSE OF A GAME ON A GAMBLING TABLE IN CASINOS

(71) Applicant: Dallmeier electronic GmbH & Co. KG, Regensburg (DE)

(72) Inventor: Dieter Dallmeier, Pettendorf (DE)

( * ) Notice: Subject to any disclaimer, the term of this patent is extended or adjusted under 35 U.S.C. 154(b) by 0 days.

(21) Appl. No.: 15/583,252

(22) Filed: May 1, 2017

(65) Prior Publication Data

US 2017/0330414 A1 Nov. 16, 2017

(30) Foreign Application Priority Data

May 13, 2016 (DE) ..... 10 2016 108 969

(51) Int. Cl.
*G07F 17/32* (2006.01)
*A63F 3/00* (2006.01)

(52) U.S. Cl.
CPC ..... *G07F 17/3227* (2013.01); *G07F 17/322* (2013.01); *G07F 17/3209* (2013.01); *G07F 17/3223* (2013.01); *G07F 17/3241* (2013.01); *G07F 17/3293* (2013.01); *A63F 3/00157* (2013.01)

(58) Field of Classification Search
CPC ..... G07F 17/3227; G07F 17/3241; G07F 17/3293; G07F 17/3209; G07F 17/3223; G07F 17/322; A63F 3/00157
See application file for complete search history.

(56) References Cited

U.S. PATENT DOCUMENTS 4,531,187 A 7/1985 Uhland
9,189,918 B1 * 11/2015 Gronkowski ..... G07F 17/3209
2004/0023722 A1 * 2/2004 Vuong ..... G07F 17/32 463/40
2005/0026680 A1 2/2005 Gururajan
(Continued)

FOREIGN PATENT DOCUMENTS

DE 10 2007 034 010 1/2009
DE 602 24 961 T2 2/2009
(Continued)

*Primary Examiner* — Jasson H Yoo
(74) *Attorney, Agent, or Firm* — Welsh Flaxman & Gitler LLC

(57) ABSTRACT

The invention relates to a system for detecting and analyzing video data (VD1 to VD3) relating to the course of a game on at least one gaming table (2) in casinos, wherein the gaming table (2) has a playing field (3) including a plurality of playing field sections (3.1 to 3.3), wherein the course of a game on the gaming table (2) is detected from at least two different side perspectives via at least a first and second camera units (6, 7) arranged on the edge of the gaming table (2), and from the bird's eye view via at least a third camera unit (8) arranged above the gaming table (2), in each case in the form of video data (VD1 to VD3), wherein the detected video data (VD1 to VD3) are transmitted to a video analysis unit (VAE) and are analyzed in the video analysis unit (VAE) by means of at least one analysis routine (AR), and that a game database, which displays the course of a game at the gaming table (2) in real time, are generated from this.

10 Claims, 3 Drawing Sheets

(56) References Cited

U.S. PATENT DOCUMENTS

| | | | | |
|---|---|---|---|---|
| 2005/0272501 | A1* | 12/2005 | Tran | G07F 17/32 463/29 |
| 2008/0113783 | A1 | 5/2008 | Czyzewski et al. | |
| 2009/0124376 | A1* | 5/2009 | Kelly | G07F 17/3206 463/29 |
| 2009/0264197 | A1* | 10/2009 | Fujimoto | A63F 9/24 463/31 |

FOREIGN PATENT DOCUMENTS

| | | | |
|---|---|---|---|
| EP | 2337355 | A2 | 6/2011 |
| WO | WO 2006/107997 | | 10/2006 |

* cited by examiner

SYSTEM AND METHOD FOR DETECTING AND ANALYZING VIDEO DATA RELATING TO THE COURSE OF A GAME ON A GAMBLING TABLE IN CASINOS

BACKGROUND OF THE INVENTION

The invention relates to a system and a method for detecting and analyzing video data relating to the course of a game on a gambling table in casinos.

In the case of gambling games, in particular card games, such as baccarat or poker in casinos, individual players or a group of players located at a gaming table often manipulate the course of a game, often by including the game leader or croupier, respectively, making illegal moves, for example, or manipulating the course of a game in another way. An extensive monitoring of the course of a game by the croupier, who runs the gambling game at the respective gaming table, and additionally by a so-called "pit supervisor", who, in addition to the croupier, monitors the course of a game at a plurality of gaming tables, is necessary to avoid such a manipulation of the course of a game by individual players and/or the croupier himself. A reliable monitoring of the course of a game to avoid such manipulation possibilities in the case of gambling games, in particular card games, is thus very personnel-intensive. Based on this, it is desirable to automatically detect the course of gambling games, in particular of card games, at corresponding gaming tables and to prepare them for an efficient and reliable monitoring of the course of a game.

A card game monitoring system, a corresponding gaming table and a corresponding monitoring method is known for example from German Patent No. DE 602 24 961 T2, in the case of which the card game monitoring system which comprises an identification information recording device, an identification information reading device, a control device, a play money processing device, a display device, a dispensing device and a recording device. The identification information recording device is hereby embodied in the form of a wireless, preferably passive transmitter, which is integrated into the playing card, in order to be able to wirelessly read the playing cards located on the gaming table or the number information located thereon, respectively, via the identification information reading device arranged at the gaming table.

Chips or jettons, respectively, which also have an integrated wireless transmitter and which can be read via reading devices provided at the gaming table in a corresponding manner and so that the number and/or the monetary value of the jettons, which are currently located on the gaming table, can be determined in an automated manner, are also already known from the prior art.

It is a disadvantage that only a monitoring of specifically equipped playing cards and/or jettons is possible in the case of the known monitoring systems. It is also a disadvantage that only certain transactions of the course of a game can be monitored individually and isolated from one another. An assignment of the detected information to individual players and/or an evaluation of their playing behavior, in particular also a monitoring of the participation of the croupier in manipulations is thus not possible, because only a small fraction of the transaction information, which is available during the course of a game, is available for the automated evaluation.

Based on this, it is an object of the present invention is to provide a system and a method for detecting and analyzing video data relating to the course of a game of a gambling game, in particular card game, on at least one gaming table in casinos, which allows an improved automated evaluation and, based on this, a monitoring of the course of a game.

SUMMARY OF THE INVENTION

A main aspect of the system according to the invention for detecting and analyzing video data relating to the course of a game on at least one gaming table in casinos can be seen in that the course of a game on the respective gaming table is detected from at least two different side perspectives via at least first and second camera units arranged on the edge of the gaming table and from the bird's eye view via at least a third camera unit arranged above the gaming table, in each case in the form of video data, wherein the detected video data are transmitted to a video analysis unit and are analyzed in the video analysis unit by means of at least one analysis routine executed therein, and in that a game database, which displays the course of a game at the gaming table, in real time is generated from this. Particularly advantageously, the gameplay at a gaming table is detected by means of a plurality of camera units, which are positioned differently, from different perspectives and/or view angles and directions and a video database is thus created, from which an "electronic display" of the gameplay is generated in a particularly advantageous manner by means of a video analysis unit connected downstream. The transaction data, which are relevant for the automated monitoring of the gameplay, are detected in the game database. Particularly advantageously, at least the relevant events of the course of a game are thus displayed in a game database, which, in addition to the monitoring of the gameplay for manipulation, can also be used for further, in particular also economic evaluations. In addition to reducing the monitoring personnel, a more efficient operation of the casino with an increased manipulation safety is achieved through this.

It is a further advantage that a first playing field section is assigned to at least one player and a second playing field section is assigned to at least the game leader and between the first and the second playing field section a central third playing field section is provided, which are analyzed by the analysis routine, preferably independently from one another. Because of the specific analysis of predetermined image sections of the detected video data, an efficient and target-oriented analysis for providing defined transaction data is possible.

In an advantageous embodiment of the invention, the time changes of the video data provided by the different camera units are analyzed and are subsequently evaluated in combination with one another, so that the relevant transaction data can advantageously be generated with the smallest possible calculating effort.

In a preferred embodiment, the first and second camera units are spaced apart from one another and are arranged opposite one another above the gaming table, wherein they are preferably arranged at different distances to the playing field and/or at different detection angles, based on the playing field. The first and second camera units are hereby embodied for recording the course of a game from two different side perspectives.

Advantageously, the third camera unit is designed for recording the course of a game from the bird's eye view.

The first and second camera units are for example configured as digital, preferably IP-enabled pinhole camera units and the third camera unit is embodied as digital, preferably IP-enabled dome camera unit.

The first camera unit detects first video data relating to the course of a game from a first side perspective, the second camera unit detects second video data relating to the course of a game from a second side perspective, and the third camera unit detects third video data relating to the course of a game from the bird's eye view.

It is also an advantage that the game database is updated dynamically and thus displays the course of a game in real time in the form of a plurality of transaction data determined via the analysis routine.

To transmit the video data in real time, the video analysis unit is connected to the camera units via at least one local network, wherein the video analysis unit is particularly preferably connected to a central database unit, in which the generated game database is stored.

A method for detecting and analyzing video data relating to the course of game on at least one gaming table in casinos is also subject of the invention, wherein the gaming table has a playing field comprising a plurality of playing field sections, wherein the course of a game on the gaming table is detected from at least two different side perspectives via at least a first and second camera units arranged on the edge of the gaming table, and from the bird's eye view via at least a third camera unit arranged above the gaming table, in each case in the form of video data, in the case of which the detected video data are transmitted to a video analysis unit and are analyzed in the video analysis unit by means of at least one analysis routine, and that a data model, which displays the course of a game at the gaming table in real time, is generated from this.

It is a further advantage that a first playing field section is assigned to at least one player and a second playing field section is assigned to at least the game leader and that provision is made between the first and the second playing field section for a central third playing field section, which are analyzed by the analysis routine, preferably independently from one another. The course of a game is further detected by means of first and second camera unit in the form of first and second video data from different side perspectives, in particular different detection angles, based on the playing field, and the course of a game is detected by means of the third camera unit in the first of the third video data from the bird's eye view.

In an advantageous embodiment, the number and/or position of the jettons located on the playing field, in particular in the first and third playing field section, is determined from the provided video data by means of the analysis routine.

By analyzing the video data, in particular the third video data, the state of a closed, unused gaming table, can be monitored by corresponding analysis of the video data.

In a particularly advantageous embodiment, the change of the number, type and/or the value of the jettons received in a jetton receiving unit and/or located on the playing field, is determined continuously or at predetermined points in time by means of the analysis routine by analyzing the video data. In particular, the height of a jetton stack and the colors of the jettons located therein can hereby also be determined from the first and second video data.

Further developments, advantages and application possibilities of the invention also follow from the below description of exemplary embodiments and from the figures. On principle, all described features and/or features, which are depicted, are thereby the subject matter of the invention, either alone or in any combination, regardless of their combination in the claims or the dependency thereof.

BRIEF DESCRIPTION OF THE DRAWINGS

The invention will be explained in more detail below by means of the figures using exemplary embodiments.

DETAILED DESCRIPTION OF THE INVENTION

Figure 1:
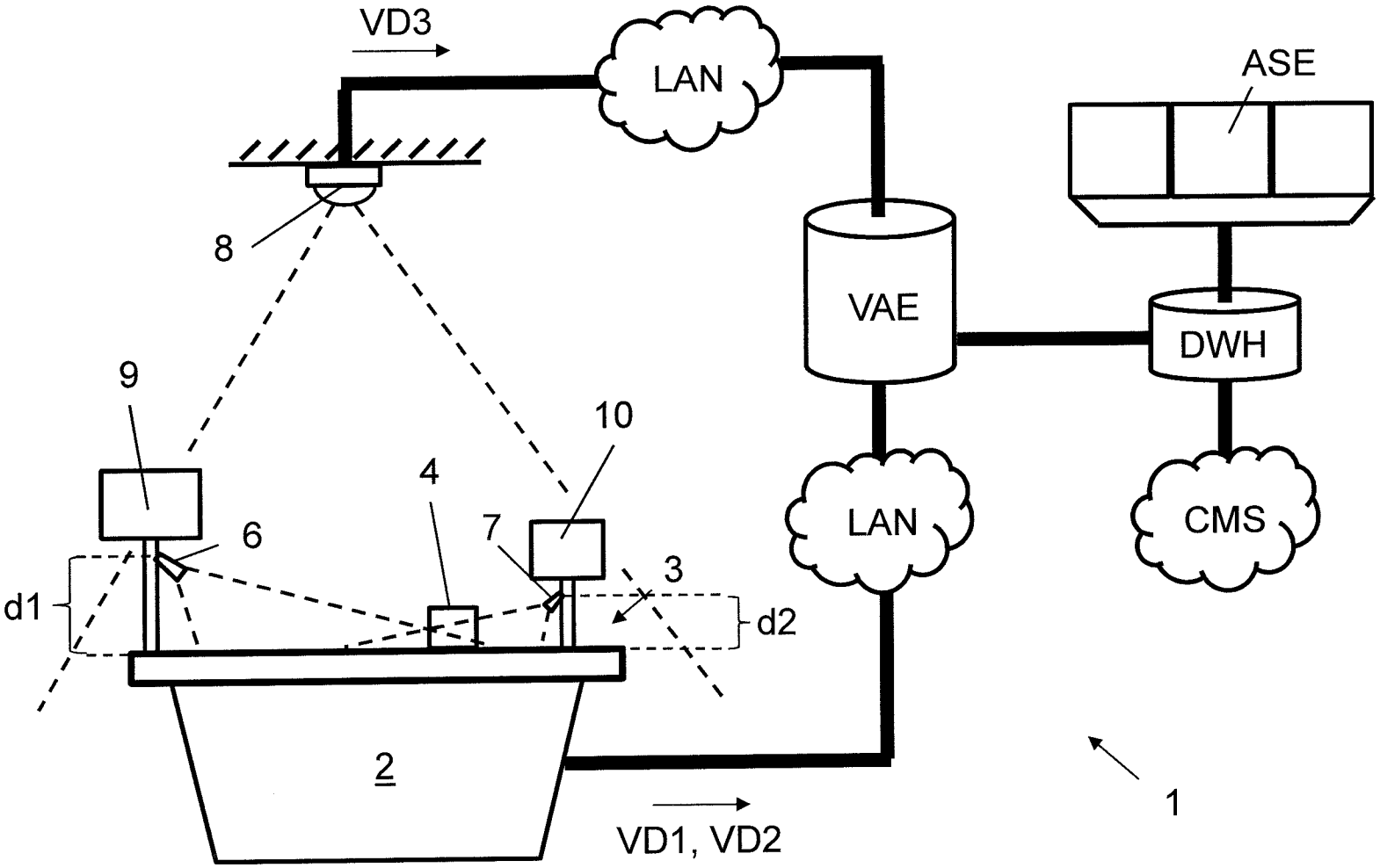
FIG. 1 shows a schematic block diagram of a system according to the invention for detecting and analyzing video data relating to the course of a game at least one gaming table in casinos.

FIG. 1 illustrates in a schematic block diagram a system 1 according to the invention for detecting and analyzing video data VD1 to VD3 relating to the course of a game on a gambling table or gaming table 2, respectively, in casinos.

For example, the gaming table 2 is set up for playing card games with a plurality of players SP and at least one croupier CP. For this purpose, the gambling table 2 has a playing field 3 comprising, for example, at least a first playing field section 3.1 in each case assigned to a player SP and at least a second playing field section 3.2 assigned to the croupier CP. Provision is further made for at least a central third playing field section 3.3, which is preferably located between the first and the second playing field section 3.3 and in which a plurality of the transactions of the gambling game or of the card game, respectively, often takes place.

Depending on the respective gambling game, the first and/or central third playing field section 3.1, 3.3 can have different field-like markers or the like, into which the stakes, for example, are placed by the respective player SP. The setup of the playing field 3, in particular of the first and third playing field section 3.1, 3.3 are thus in each case dependent on the rules of the gambling game, which is played on the respective gaming table 2. The playing field sections 3.1 to 3.3 can hereby be embodied at a distance to one another, to adjoin one another or to overlap one another at least in sections. In particular in the case of the baccarat card game, it will be assumed hereinafter that the placing of the stakes by the individual players SP is in each case made in the first playing field section 3.1 assigned to the individual players.

During a card game, for example, a plurality of playing cards SP and/or so-called tokens or jettons J are located on the gaming table 2 or playing field 3, respectively. Such jettons J are preferably coin-like tokens or chips, respectively, made of plastic, which are used as play money in casinos. Depending on the color and/or the digits or numbers, respectively, applied thereto, different values of a predetermined currency are assigned thereto, namely in an unambiguous manner.

Figure 2:
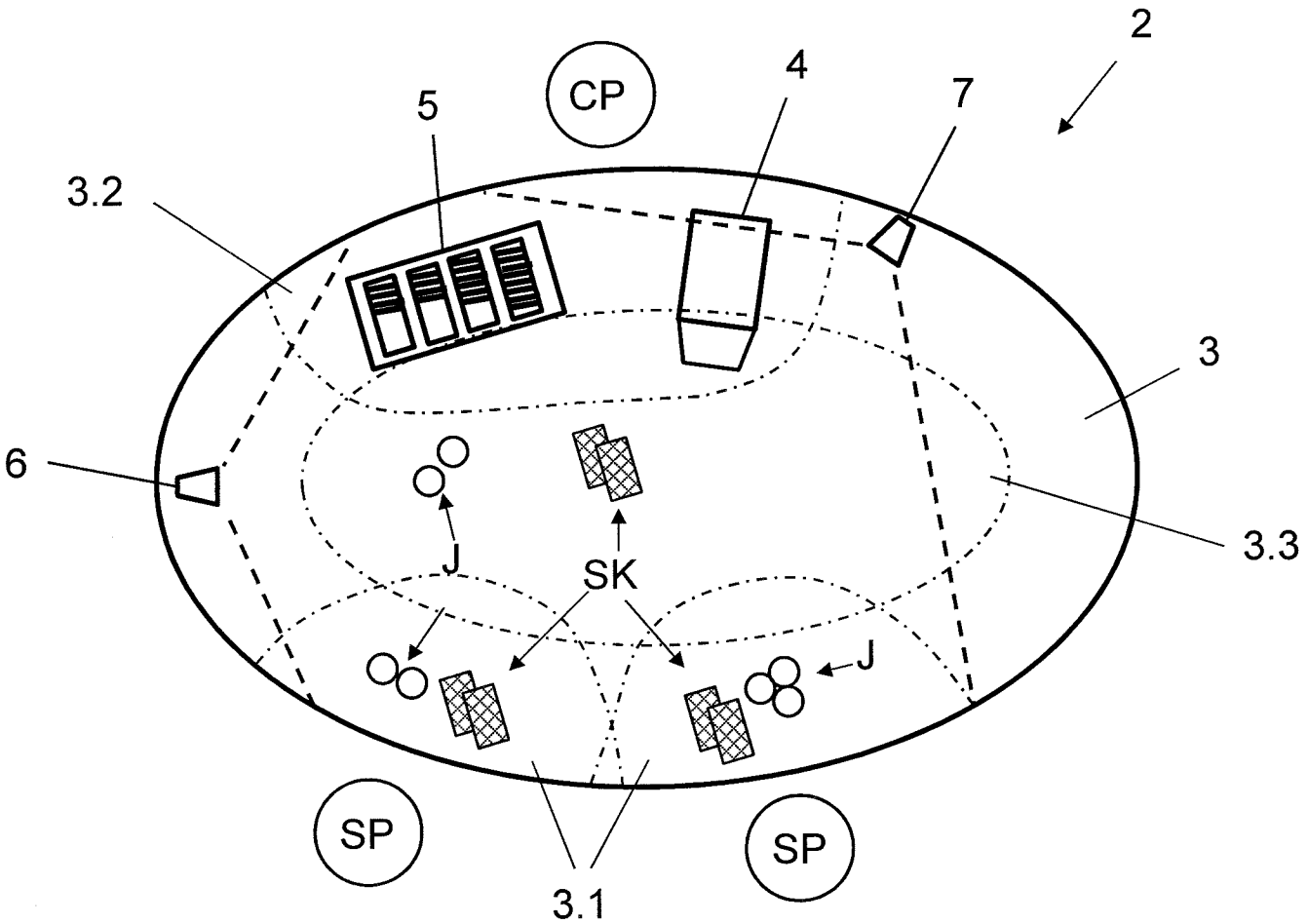
FIG. 2 shows a schematic top view onto such a gaming table.

FIG. 2 shows, for example, a schematic top view onto the gaming table 2, at which for example two players SP and a croupier CP are currently seated and at which a card game is played. For example the playing cards SK and jettons J of a player SP are located in first playing field sections 3.1, which are assigned to the players SP. In the case of a card game, provision is made in the second playing field section 3.2, which is assigned to the croupier CP, for example for a card chute unit 4 for dispensing the playing cards SK as well as for a jetton receiving unit 5 for receiving the jettons J, which are not part of the game. Provision is also made in the third playing field section 3.3 for example for playing cards SK and jettons J.

The system 1, which is illustrated in FIG. 1 in an exemplary manner, further comprises at least a first and second camera unit 6, 7, which are in each case arranged on the edge or in the edge area, respectively, of the playing field 3 and at a distance to the playing field 3, as well as at least a third camera unit 8, which is arranged above or on top of the gaming table 2, respectively, and which is designed to be mounted to a ceiling, for example. The first and second camera units 6, 7 thus form "table camera units", which are connected to the gaming table 2, and the third camera unit 8 forms a "ceiling camera unit", which is arranged approximately vertically above the center of the gaming table 2.

The first and second camera unit 6, 7 are embodied to detect the course of a game from a first or second side perspective, respectively, in the form of first and second video data VD1, VD2, i.e. the course of a game is electronically detected on the gaming table 2 from two different side perspectives by means of the first and second camera units 6, 7, namely preferably in the form of an image data stream comprising a plurality of chronologically consecutive individual images.

The first and second camera unit 6, 7 are spaced apart from one another and are preferably arranged located opposite one another at a distance to the playing field 3 above the gaming table. The detection angle of the first and second camera units 6, 7, based on the plane spanned by the playing field 3, is chosen differently. The first and second camera unit 6, 7 preferably have a different distance d1, d2 to the playing field 3 or to the surface of the gaming table 2, respectively, so that the course of a game can in particular be detected from different height perspectives by the first and second camera unit 6, 7. The distance d1 to the playing field 3 or to the surface of the gaming table 2, respectively, of the first camera unit 6 is preferably larger than the distance d2 of the second camera unit 7.

In an alternative embodiment, the first and/or second camera unit 6, 7 are received in the holding unit of a display device 9, 10 and are for example embodied as pinhole camera units. They are furthermore in particular embodied as digital camera units 6, 7, preferably as Internet protocol-enabled or IP-enabled digital camera units 6, 7, respectively.

The third camera unit 8 is realized as dome camera unit, for example, which is embodied for recording the playing field 2 and thus the course of a game from the bird's eye view. By means of the third camera unit 8, the course of a game is detected from the bird's eye view in the form of third video data VD3, which, in turn, comprise a plurality of chronologically consecutive individual images and thus form a so-called image data stream. The third camera unit 8 is preferably also realized as digital camera unit, which is Internet protocol-enabled.

The video data VD1 to VD3 generated by the mentioned camera units 6 to 8 are transmitted in a wired or wireless manner to a video analysis unit VAE via suitable transmission media. The transmission of the video data VD1 to VD3 preferably takes place in real time via a local network LAN, namely by using the Internet protocol (IP).

For example a central database unit DWH, also called data warehouse unit, is connected to the video analysis unit VAE. The central database unit DWH is set up accordingly for the video data analysis purposes at hand, in particular for combining and compressing the video data VD1 to VD3 provided by different video camera units 6-8 and of other data, if applicable, from data sources, which will be described in more detail below, in particular sensor units.

A display and/or control device ASE, via which the detected and analyzed video data VD1 to VD3 as well as the results obtained by the analysis thereof can be displayed to the user, is further connected to the central database unit DWH. For this purpose, the display and/or control device ASE preferably has a plurality of monitor units and at least one control panel, in particular a keypad and an input unit.

In the embodiment illustrated in FIG. 1, the central database unit DWH is further also connected to a content management system CMS, via which a central management and/or target group-dependent display of text or multimedia data is provided for display on different computer systems via a web browser.

Provision can also be made at the gaming table 2 for additional sensor units, via which further transaction information can be detected in an automated manner during the course of a gambling game, in addition to the described image detection. For example, provision can be made in the card chute unit 4 for a sensor, via which the type and/or the value of the currently dispensed playing card SK can be detected. The transaction data provided by such additional sensor units are also transmitted to the video analysis unit VAU and can be evaluated by the latter in addition to the analysis of the current course of a game.

Figure 3:
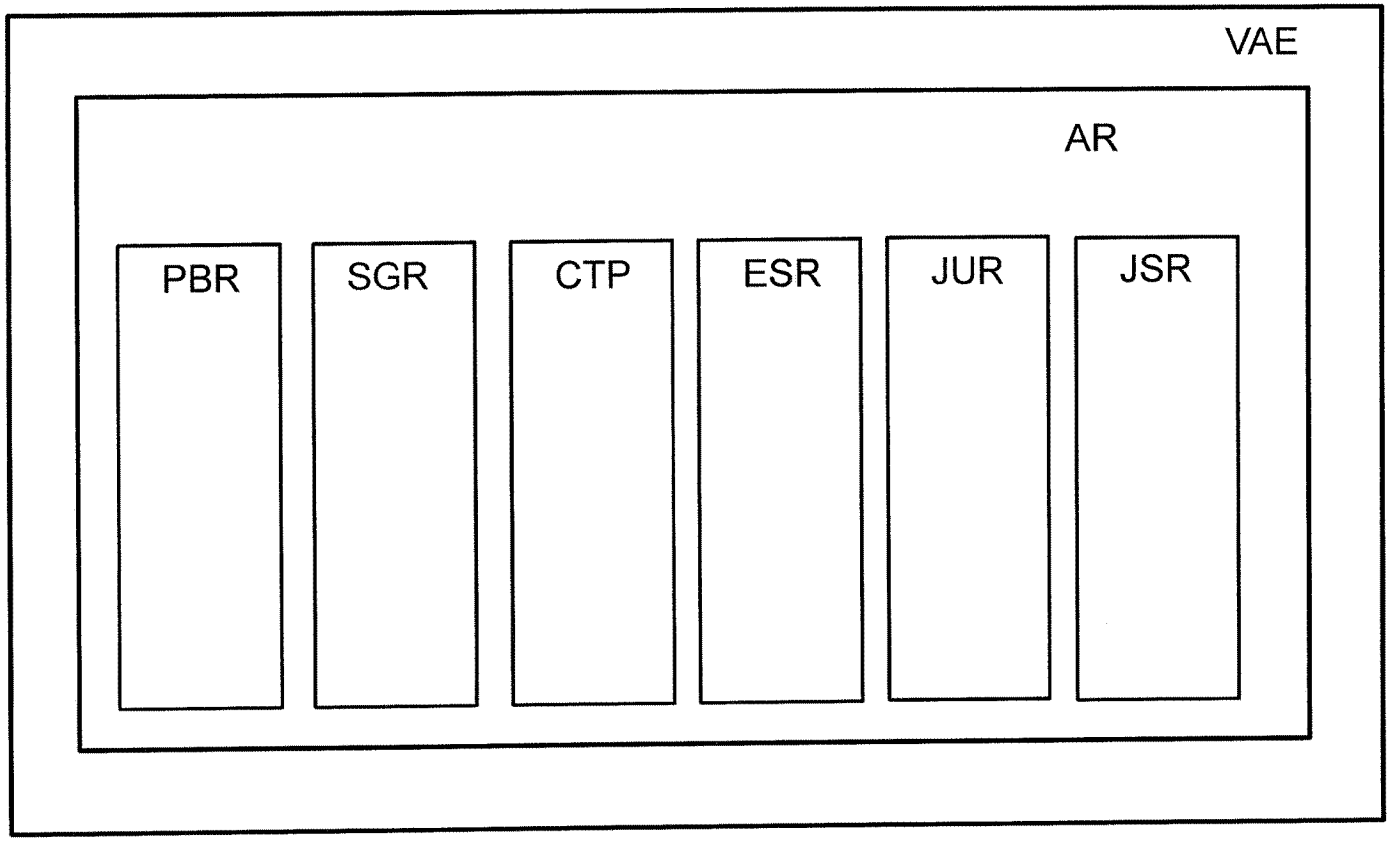
FIG. 3 shows a schematic block diagram of the video analysis unit.

FIG. 3 shows a schematic block diagram of the video analysis unit VAE, in which an analysis routine AR is carried out according to the invention, via which the video data VD1 to VD3, which are detected by the different camera units 6, 7, 8 and which are transmitted to the video analysis unit VAE, are combined with one another and a game database, which displays the course of a game at the gaming table 2 in real time, is generated therefrom. The generated database comprises a plurality of transaction data, which are obtained from the video data VD1 to VD3 and which depict the chronological course of selected game events and which, from the overall view, represent a "three-dimensional" electronic display of the course of a game in real time.

Methods for analyzing video data in real time, which are known per se, and the general structure and mode of operation of which are described in PCT Patent Application Publication No. WO 2006/107997 A2 or in German Patent No. DE 10 2007 034 010 A1, are used in the analysis routine AR. Changes in the individual images of the image stream of the video data VD1 to VD3 are detected hereby and a conclusion is drawn to the presence of certain events by means of corresponding analysis or evaluation, respectively, of the changes.

To generate the transaction data, which form the game database, the analysis routine AR has a plurality of analysis routines, via which selected game states and/or game events are determined in the form of transaction data from the provided video data VD1 to VD3 by means of corresponding video analysis. By means of the generation of video data VD1 to VD3 according to the invention from different perspectives, namely at least two different side perspectives and the bird's eye view as well as the additional evaluation, if applicable, of further sensor data, the course of a game can be detected and analyzed in an automated manner and a game database, which reflects the course of a game in real time, can be generated therefrom for the first time.

For example, the analysis routine AR has a positioning routine PBR, by means of which the number and/or position of jettons J on the gaming table 2 or the playing field 3, respectively, in particular in the first and central third playing field section 3.1, 3.3 is determined from the provided video data VD1 to VD3 by corresponding video analysis. For this purpose, in particular the first and second video data VD1, VD2, which are provided by the first and second camera unit 6, 7, and the third video data VD3, which are provided by the third camera unit 8, are analyzed based on the changes in the first and central third playing field section 3.1, 3.3. The number and/or position of jettons J in the first and/or third playing field section 3.1, 3.3 is thus determined by means of the positioning routine PBR, depending on the provided video data VD1 to VD3.

A game speed routine SGR is also provided, via which the length of time of a plurality of games, in particular card games, is detected and a measure for the average speed of a game can be determined from this. For this purpose, the first-time placement by a player SP after a game, which ended beforehand and thus prior to the beginning of a new game, which is evaluated as predetermined event, is detected by evaluating the video data VD1-VD3. The end of the game is determined for example by the croupier CP returning the playing cards SK back into the card chute unit 4. The point of time, at which this event is at hand, is determined by the corresponding analysis of the first to third video data VD1-VD3 and the length of time of a game is calculated in consideration of the point in time, at which the game started. In addition, the average length of time of the placing operation of a player can be determined as a function of the dealing of the following playing card SK.

To create the game database, which dynamically displays the course of a game, provision can further be made for a monitoring routine CTP, via which the state of a closed gaming table, i.e. which is not currently used ("closed table"), is monitored. For this purpose, the third video data VD3, which are provided by the third camera unit 8, are preferably evaluated. It is checked in particular whether no change of the third video data VD3 is at hand, based on the first and/or third playing field sections 3.1, 3.3, i.e. that no game activity is at hand. In addition, it can also be checked whether or not a respective operating unit, which is in each case provided at the gaming table 2, is activated by the croupier CP, i.e. whether or not the table is used.

The game movements of the individual players SP in the first playing field sections 3.1 and/or in the third central playing field sections 3.3 assigned to them are evaluated by means of a use routing ESR by corresponding analysis of the video data VD1-VD3 in the area of the mentioned sections and the point in time, at which the players place their stake, is determined and is correlated to the remaining course of a game, in particular in order to detect a belated placing by the respective player.

The change of the number, type and/or the value of the jettons J, which are received in the jetton receiving unit 5 and/or which are located on the playing field 2, are detected continuously during the course of a game or at predetermined points in time via a jetton circulation routine JUR. From the knowledge of this transaction information or by corresponding evaluation, respectively, of the corresponding transaction data provided by the jetton circulation routine JUR, a plurality of further information can be derived via the current gameplay in a casino. For example, the jetton, which is currently in circulation at all gaming tables of a casino, can thus be determined in real time and the corresponding monetary value can be determined therefrom.

The first and second video data VD1, VD2 provided by the first and second camera unit 6, 7, which in particular show the first and/or third playing field section 3.1, 3.3 at different side perspectives, are preferably analyzed by means of a jetton stack routing JSR and the number of a plurality of jettons J stacked on top of one another and, if applicable, their value is additionally determined. In particular, the height of the jetton stack and the colors of the jettons J located therein are determined from the first and second video data VD1, VD2. The stakes of one or a plurality of players or of the entire game can be detected through this.

In addition to the analysis routines of the analysis routine AR, which have already been described in more detail, provision can be made for further analysis routines, which for example determine the highest value of a jetton J in the first and/or third playing field section 3.1, 3.3 or the bidder zone of the playing field 3, respectively, or which review the buy-in of a new player at an open gaming table 2.

The mentioned analysis routines of the analysis routine AR thus provide for a dynamic detection and analysis of the current course of a game at gambling tables in casinos.

The invention has been described above using exemplary embodiments. It goes without saying that numerous changes as well as modifications are possible, without thereby leaving the inventive idea, on which the invention is based.

REFERENCE LIST

1 system
2 gaming table
3 playing field
3.1 first playing field section
3.2 second playing field section
3.3 third playing field section
4 card chute unit
5 jetton receiving unit
6 first camera unit
7 second camera unit
8 third camera unit
9 display device
10 display device
ASE display and/or control device
d1, d2 distances
CP croupier
CMS content management system
CTP monitoring routine
DWH central database unit
ESR use routine
J jettons
JUR jetton circulation routine
JSR jetton stack routine
LAN local network
PBR positioning routine
SGR game speed routine
SP player
SK playing cards
VAE video analysis unit
VD1 first video data
VD2 second video data
VD3 third video data

What is claimed is:

1. A system for detecting and analyzing video data relating to a course of a game on a gaming table in a casino, wherein the system includes a gaming table having a playing field comprising a plurality of playing field sections, a first camera unit, a second camera unit, a third camera unit, a video analysis unit, at least one analysis routine, and a display, whereby the course of the game on the gaming table is detected from at least two different side perspectives via the first camera unit and the second camera unit arranged on an edge of the gaming table, and from a bird's eye view via the third camera unit arranged above the gaming table, in each case in the form of detected video data, wherein the detected video data are transmitted to the video analysis unit and are analyzed in the video analysis unit by the at least one analysis routine, the at least one analysis routine comprises:

a positioning routine whereby a number of a plurality of jettons and a position of the plurality of jettons on the gaming table are determined from detected video data collected from the first camera unit, the second camera unit and the third camera unit and the detected video data is analyzed based on changes in the number of jettons and the position of the plurality of jettons on a first playing field section assigned to at least one player, a second playing field section assigned to at least one game leader, and a central third playing field section provided between the first playing field section and the second playing field section, the first playing field section, the second field section, and the central third playing field section are analyzed by the positioning routine, independently from one another to build the generated game database with the position of the plurality of jettons being analyzed, and a game speed routine determining an average length of a game by detecting and measuring the video data collected from the first camera unit, the second camera unit and the third camera unit whereby a first-time placement of the jetton by a player prior to the beginning of a new game is collected and the time when the game leader who deals the cards returns the playing cards back into a card chute unit is also collected to determine the length of the game and a plurality of games are measured to collect and evaluate an average length of the game to further build a generated game database, and the generated game database displays the course of a game at the gaming table on a display in real time using the generated game database, and wherein the first camera unit and the second camera unit are spaced apart from one another and are arranged opposite one another above the gaming table, wherein the first camera unit and the second camera unit record the course of the game from two different side perspectives and the third camera records the course of the game from the bird's eye view, and wherein the first camera unit detects first video data relating to the course of the game from a first side perspective, the second camera unit detects second video data relating to the course of the game from a second side perspective, and the third camera unit detects third video data relating to the course of the game from the bird's eye view, and wherein the generated game database is updated dynamically and displays the course of the game on the display in real time in the form of a plurality of transaction data determined via the at least one analysis routine, and wherein a first video data, a second video data and a third video data are transmitted to the video analysis unit, and are combined with one another and the generated game database is generated therefrom, the generated game database comprises the plurality of transaction data, which are obtained from the first video data, the second video data and the third video data and which depict a chronological course of selected game events by collection data in a three-dimensional electronic manner and displaying the chronological course of the game in real time.

2. The system according to claim 1, wherein time changes of the detected video data provided by the first camera unit, the second camera unit, and the third camera unit are analyzed and are subsequently evaluated in combination with one another.

3. The system according to claim 1, wherein the first camera unit and the second camera unit are configured as digital, IP-enabled pinhole camera units and the third camera unit is a digital, IP-enabled dome camera unit.

4. The system according to claim 1, whereby to transmit the detected video data in real time, the video analysis unit is connected to the first camera unit, the second camera unit, and the third camera unit via at least one local network.

5. The system according to claim 1, wherein the video analysis unit is connected to a central database unit, in which the generated game database is stored.

6. A method for detecting and analyzing video data relating to a course of a game on a gaming table in casinos, wherein the gaming table has a playing field comprising a plurality of playing field sections, comprising the steps of:

detecting the course of a game on the gaming table from at least two different side perspectives via at least a first camera unit and a second camera unit arranged on an edge of the gaming table, and from a bird's eye view via at least a third camera unit arranged above the gaming table, in each case in the form of video data;

transmitting detected video data to a video analysis unit and analyzing in the video analysis unit by at least one analysis routine;

generating a data model which displays the course of the game at the gaming table on a display in real time;

spacing the first camera unit and the second camera unit apart from one another and arranging the first camera unit and the second camera unit opposite one another above the gaming table;

recording the course of the game from two different side perspectives using the first camera unit and the second camera unit and recording the course of the game from the bird's eye view using the third camera unit;

detecting a first video data relating to the course of the game from a first side perspective using the first camera unit, detecting second video data relating to the course of the game from a second side perspective using the second camera unit;

detecting third video data relating to the course of the game from the bird's eye view using the third camera;

creating an analysis routine comprising:

a positioning routine whereby a number of a plurality of jettons and a position of the plurality of jettons on the gaming table are determined from detected video data collected from the first camera unit, the second camera unit and the third camera unit and the data and the data is analyzed based on changes in the number of jettons and the position of the plurality of jettons on a first playing field section assigned to at least one player, a second playing field section assigned to at least one game leader, and a central third playing field section provided between the first playing field section and the second playing field section, the first playing field section, the second field section, and the central third playing field section are analyzed by the positioning routine, independently from one another to build a generated game database with the position of the plurality of jettons being analyzed, and a game speed routine determining an average length of a game by detecting and measuring the video data collected from the first camera unit, the second camera unit and the third camera unit, whereby a first-time placement of the jetton by a player prior to the beginning of a new game, is collected and the time when the game leader who deals the cards returns the playing cards back into a card chute unit is also collected, to determine the length of the game and a plurality of games are measured to collect and evaluate an average length of the game to further build the generated game database, dynamically updating the generated game database, transmitting the first video data, the second video data and the third video data to the video analysis unit and combining the first video data, the second video data and the third video data with one another;

generating the game database from the first video data, the second video data and the third video data as combined during the step of combining, the generated game database generated therefrom comprises the plurality of transaction data, which are obtained from the first video data, the second video data and the third video data and which depict a chronological course of selected game events by collection data in a three-dimensional electronic manner and displaying the chronological course of the game in real time.

7. The method according to claim 6, wherein a number and/or a position of jettons located on the playing field, in the first playing field section and third playing field section, is determined from the detected video data by the analysis routine.

8. The method according to claim 6, whereby analyzing the video data, a state of a closed, unused gaming table is monitored by the analysis routine.

9. The method according to claim 6, wherein a change of a number, type and/or a value of jettons received in a jetton receiving unit and/or located on the playing field, is determined continuously or at predetermined points in time by the analysis routine by analyzing the detected video data.

10. The method according to claim 9, wherein a height of a jetton stack and colors of the jettons located therein are determined from the first video data and second video data.

* * * * *